US006983735B2

(12) United States Patent
Toyoshima et al.

(10) Patent No.: US 6,983,735 B2
(45) Date of Patent: Jan. 10, 2006

(54) CONTROL APPARATUS FOR CONTROLLING THE AMOUNT OF INTAKE AIR INTO AN ENGINE

(75) Inventors: Hirokazu Toyoshima, Saitama (JP); Naoki Oie, Saitama (JP); Masaaki Nagashima, Saitama (JP); Yasuo Takagi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 22 days.

(21) Appl. No.: 10/916,628

(22) Filed: Aug. 12, 2004

(65) Prior Publication Data

US 2005/0066937 A1 Mar. 31, 2005

(30) Foreign Application Priority Data

Sep. 3, 2003 (JP) ..... 2003-311292

(51) Int. Cl.
*F02D 41/16* (2006.01)
*F02M 25/06* (2006.01)

(52) U.S. Cl. ..... 123/339.15; 123/339.25; 123/572; 123/396

(58) Field of Classification Search ..... 123/339.1, 123/339.12, 229.14, 339.15, 339.19, 339.23, 123/339.25, 339.26, 396, 399, 403, 572, 123/198 D; 73/117.3, 118.1, 118.2
See application file for complete search history.

(56) References Cited

U.S. PATENT DOCUMENTS

| | | | | |
|---|---|---|---|---|
| 5,024,196 | A * | 6/1991 | Ohuchi | 123/339.22 |
| 6,016,787 | A * | 1/2000 | Sakai et al. | 123/339.12 |
| 6,098,603 | A * | 8/2000 | Maegawa et al. | 123/572 |
| 6,247,464 | B1 * | 6/2001 | Maegawa et al. | 123/572 |
| 6,338,329 | B2 * | 1/2002 | Maegawa et al. | 123/339.15 |

FOREIGN PATENT DOCUMENTS

| | | |
|---|---|---|
| JP | 2558153 | 5/1997 |
| JP | 2002-130035 | 5/2002 |

* cited by examiner

*Primary Examiner*—Willis R. Wolfe, Jr.
(74) *Attorney, Agent, or Firm*—Arent Fox PLLC

(57) ABSTRACT

A control for controlling an intake air into an engine is provided. A control valve for adjusting an amount of the intake air into the engine is provided. A desired opening degree of a control valve provided in an intake air passage into the engine is determined based on a clogging coefficient. The clogging coefficient indicates a degree of clogging of the intake air passage. An opening degree of the control valve is controlled to converge to the desired opening degree. The clogging coefficient is updated based on a feedback correction amount for feedback controlling a rotational speed of the engine during idling operation. If a leakage in a blow-by gas passage that is connected between the engine and the intake air passage is detected, the update of the clogging coefficient is prohibited.

20 Claims, 11 Drawing Sheets

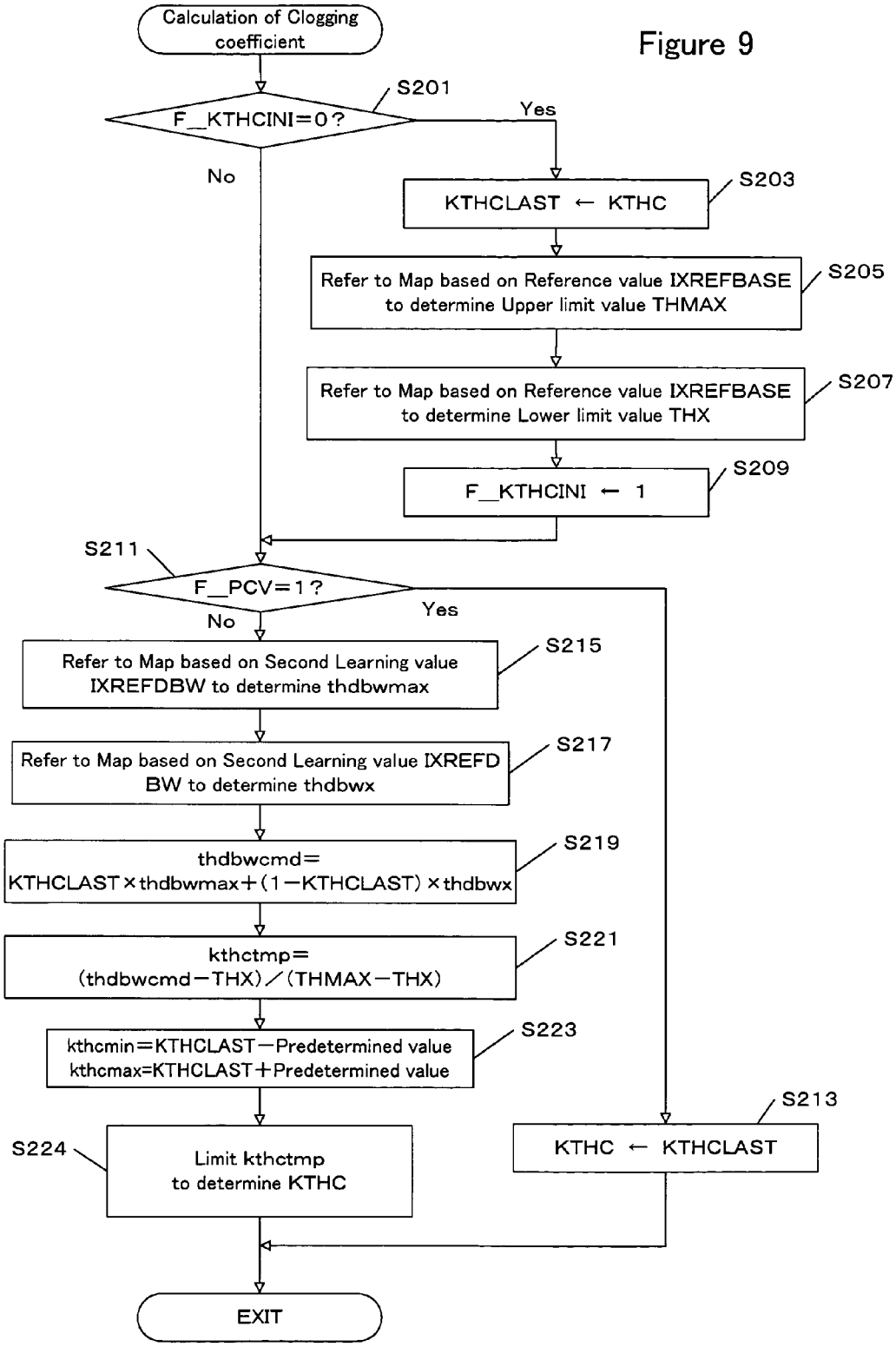
Calculation of Clogging coefficient
Figure 9
S201
F_KTHCINI=0?
Yes
No
S203
KTHCLAST ← KTHC
S205
Refer to Map based on Reference value IXREFBASE to determine Upper limit value THMAX
S207
Refer to Map based on Reference value IXREFBASE to determine Lower limit value THX
S209
F_KTHCINI ← 1
S211
F_PCV=1?
Yes
No
S215
Refer to Map based on Second Learning value IXREFDBW to determine thdbwmax
S217
Refer to Map based on Second Learning value IXREFD BW to determine thdbwx
S219
thdbwcmd= KTHCLAST×thdbwmax+(1−KTHCLAST)×thdbwx
S221
kthctmp= (thdbwcmd−THX)/(THMAX−THX)
S223
kthcmin=KTHCLAST−Predetermined value
kthcmax=KTHCLAST+Predetermined value
S213
KTHC ← KTHCLAST
S224
Limit kthctmp to determine KTHC
EXIT

CONTROL APPARATUS FOR CONTROLLING THE AMOUNT OF INTAKE AIR INTO AN ENGINE

BACKGROUND OF THE INVENTION

The present invention relates to a control apparatus for controlling the amount of intake air into the engine in accordance with a leakage in a blow-by gas passage.

It is known that a control valve, which is disposed in an intake manifold connected to an internal-combustion engine (hereinafter referred to as an "engine"), is clogged with carbon (it may be referred to as carbon deposit) with years of use due to deposition of lubricating oil and combustion products.

Japanese Registered Utility Model Publication No. 2558153 discloses a scheme for correcting the amount of intake air in accordance with the degree of clogging of a bypass valve that is disposed in a passage that bypasses a throttle valve.

According to the scheme, a valve for increasing/decreasing the amount of intake air is additionally provided in the bypass passage. At a first desired engine rotational speed, an opening degree D1 of the bypass valve when the additional valve is in a closed position and an opening degree D2 of the bypass valve when the additional valve is in an open position are learned. If the additional valve is closed when the opening of the bypass valve is fixed to D2, the engine rotational speed decreases. The additional valve is then opened to learn an opening degree D3 of the bypass valve. A characteristic of the intake air amount with respect to the opening degree of the bypass valve is updated so that changes in the intake air amount when the opening degree of the bypass valve changes from D1 to D2 are equal to changes in the intake air amount when the opening degree of the bypass valve changes from D2 to D3. Thus, accuracy of controlling the intake air amount is improved by updating the characteristic of the intake air amount.

On the other hand, blow-by gas may leak from a combustion chamber to a crankcase of the engine. There is a conventional scheme for returning the blow-by gas into an intake air system of the engine so as to prevent emission of such blow-by gas to the atmosphere. Japanese Patent Application Unexamined Publication (Kokai) No. 2002-130035 discloses a scheme for detecting a leakage (including disconnection and hole) of a passage that is designed to return the blow-by gas into the intake air system. According to the scheme, if a difference between the amount of air that is actually introduced into the engine and a desired amount of intake air that is calculated by a control unit exceeds a predetermined value, it is determined that a leakage has occurred.

According to the conventional scheme, when the intake air amount increases due to a leakage in the blow-by gas passage, it may be erroneously determined that clogging of the control valve disposed in the intake manifold has been eliminated. The characteristic of the intake air amount may be inappropriately updated. After the leakage of the blow-by gas passage is repaired, control of the intake air amount may start based on such inappropriate characteristic of the intake air amount. This may cause instability in the operating condition of the engine.

If the characteristic of the intake air amount is updated immediately after a leakage occurs, it is determined that an actual intake air amount into the engine has converged to a desired intake amount. Such updating eliminates a difference between the actual and desired intake air amounts, which may make it difficult to detect the leakage.

Thus, there exists a need for a control apparatus that is capable of prohibiting updating the characteristic of the intake air amount if a leakage is detected in the blow-by gas passage. There also exists a need for a control apparatus that is capable of adjusting a speed of updating the characteristic of the intake air amount so as to ensure detection of a leakage in the blow-by gas passage.

SUMMARY OF THE INVENTION

According to one aspect of the present invention, a control apparatus for controlling the amount of intake air into an engine is provided. The control apparatus comprises a control valve provided in an intake air passage into the engine and a control unit. The control unit updates a clogging efficient based on a feedback correction amount for feedback controlling a rotational speed of the engine during idling operation. The clogging efficient indicates a degree of clogging of the intake air passage. The control unit determines a desired opening degree of the control valve based on the clogging coefficient and causes an opening degree of the control valve to converge to the desired opening degree. The control unit is further configured to prohibit the update of the clogging coefficient if a leakage in a blow-by gas passage connected between the engine and the intake air passage is detected.

According to the invention, since updating the clogging coefficient is prohibited if a leakage is detected in the blow-by gas passage between the engine and the intake air passage, it is prevented to update the intake air characteristic based on an erroneous determination that clogging has been eliminated. After the blow-by gas passage is repaired, the intake air amount control can start based an appropriate intake air characteristic.

According to one embodiment of the invention, the clogging coefficient is updated so that a difference between a current value of the clogging coefficient and a previous value of the clogging coefficient is within a predetermined range. Thus, a range within which the clogging coefficient is updated is limited. Such limitation prevents the intake air characteristic from instantly changing. Since a rate at which the intake air characteristic is updated is limited, it is ensured that a leakage in the blow-by gas passage is detected.

According to one embodiment of the invention, a controlled variable for controlling the opening degree of the control valve is determined based on the feedback correction amount. The desired opening degree of the control valve is determined based on the controlled variable and the clogging coefficient.

According to one embodiment of the invention, the feedback correction amount is smoothed to determine a learning value. The clogging coefficient is determined based on the learning value.

BRIEF DESCRIPTION OF THE DRAWINGS

FIG. 9 shows a flowchart of a process for calculating a clogging coefficient in accordance with one embodiment of the present invention.

DESCRIPTION OF THE PREFERRED EMBODIMENTS

Figure 1:
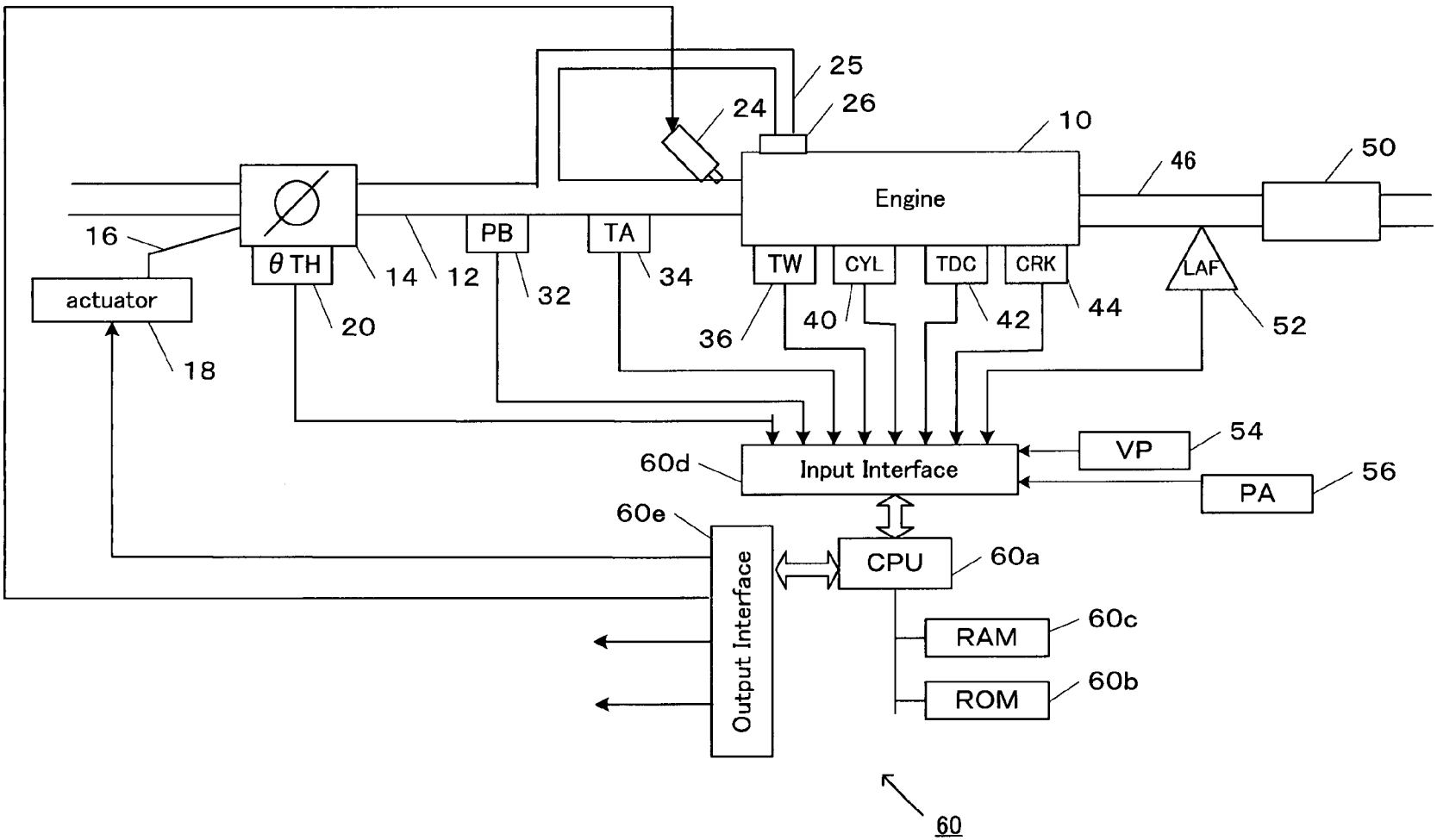
FIG. 1 is a schematic diagram showing an engine and a control unit in accordance with one embodiment of the present invention.

Referring to the drawings, preferred embodiments of the invention will be described. FIG. 1 is a block diagram showing an internal combustion engine (hereinafter referred to as an engine) and a control unit for controlling idle rotational speed of the engine in accordance with one embodiment of the invention. An engine 10 is, for example, a four-cylinder automobile engine.

A throttle valve 14 is disposed in an intake manifold 12. The throttle valve 14 is driven by an actuator 18 in accordance with a control signal from an electronic control unit (ECU) 60. Based on an output from an accelerator pedal opening sensor (not shown), the ECU 60 sends the control signal to the actuator 18 for controlling an opening degree of the throttle valve 14. This scheme is called a drive-by-wire scheme. Another scheme may be used. For example, a wire 16 is connected to the accelerator pedal so that the accelerator pedal directly controls the throttle valve. The amount of air taken into the engine is adjusted by controlling an opening degree of the throttle valve.

A throttle valve opening sensor 20 is disposed near the throttle valve 14 to output a signal corresponding to an opening degree θTH of the throttle valve.

A fuel injection valve 24 is disposed, for each cylinder, between the throttle valve 14 and an intake valve of the engine 10. The fuel injection valve 24 is connected to a fuel pump (not shown) to receive a fuel supply from a fuel tank (not shown) through the fuel pump. The fuel injection valve 24 is driven in accordance with a control signal from the ECU 60.

A blow-by gas passage 25 is disposed between a crankcase (not shown) of the engine 10 and the intake manifold 12. The blow-by gas passage 25 returns the blow-by gas back to the intake manifold 12. The blow-by gas is a gas leakage into the crankcase of the engine 1. A PCV (Positive Crankcase Ventilation) valve 26 is disposed at a portion where the blow-by gas passage 25 is connected to the crankcase.

An intake manifold pressure sensor 32 and an intake air temperature sensor 34 are disposed downstream of the throttle valve 14 in the intake manifold 12. These sensors output electric signals representing the absolute pressure Pb and the temperature TA in the intake manifold 12, respectively.

An engine water temperature (Tw) sensor 36 is attached to the cylinder peripheral wall, which is filled with cooling water, of the cylinder block of the engine 10. A temperature of the engine cooling water detected by the Tw sensor 36 is sent to the ECU 60.

A cylinder discrimination sensor (CYL) 40 is disposed around a camshaft or a crankshaft of the engine 10, to output a cylinder discrimination signal CYL, for example, at a predetermined crank angle position of the first cylinder. A TDC sensor 42 and a crank angle sensor (CRK) 44 are disposed. The TDC sensor 42 outputs a TDC signal at a crank angle position that is associated with a top-dead-center (TDC) position of the piston for each cylinder. The CRK sensor 44 outputs a CRK signal at a predetermined crank angle position. The cycle length of the CRK signal (for example, 30 degrees) is shorter than the cycle length of the TDC signal.

An exhaust manifold 46 is connected to the engine 10. Exhaust gas from the combustion is purified by a catalyst converter 50 and then emitted. A full range air/fuel ratio (LAF) sensor 52 is disposed upstream of the catalyst converter 50. The LAF sensor 52 outputs a signal representing the oxygen concentration in the exhaust gas in a wide air-fuel ratio zone, from a rich zone where the air-fuel ratio is richer than the theoretical air-fuel ratio to an extremely lean zone.

A vehicle speed sensor 54 is disposed around a driving shaft that drives the wheels, to output a signal per predetermined number of rotations of the driving shaft. An atmospheric pressure sensor 56 is provided in the vehicle to output a signal corresponding to the atmospheric pressure.

The outputs of these sensors are sent to the ECU 60. The ECU 60 is typically implemented by a microcomputer. The ECU 60 has a processor CPU 60*a* for performing calculations, a ROM 60*b* for storing control programs, various data and tables, and a RAM 60*c* for temporarily storing the calculation results by the CPU 60*a* and other data. The outputs of the various sensors are input to an input interface 60*d* of the ECU 60. The input interface 60*d* includes a circuit for shaping input signals to modify their voltage levels and an A/D converter for converting the signals from analog to digital.

The CPU 60*a* counts CRK signals from the crank angle sensor 44 to detect an engine rotational speed NE and counts signals from the vehicle speed sensor 54 to detect a vehicle speed VP. CPU 60*a* performs operations in accordance with the programs stored in the ROM 60*b* to send driving signals to the fuel injection valve 24, the throttle valve actuator 18 and other elements through an output interface 60*e*.

Alternatively, a mechanical throttle valve may be used instead of the above-described throttle valve 14 that is electrically driven to open/close. In this case, an electromagnetic valve that is driven to open/close in accordance with a control signal from the ECU is provided in a passage that bypasses the throttle valve. The amount of air taken into the engine can be adjusted by controlling an opening degree of the electromagnetic valve. It should be noted that the term of "intake air passage" includes such a bypass passage.

Figure 2:
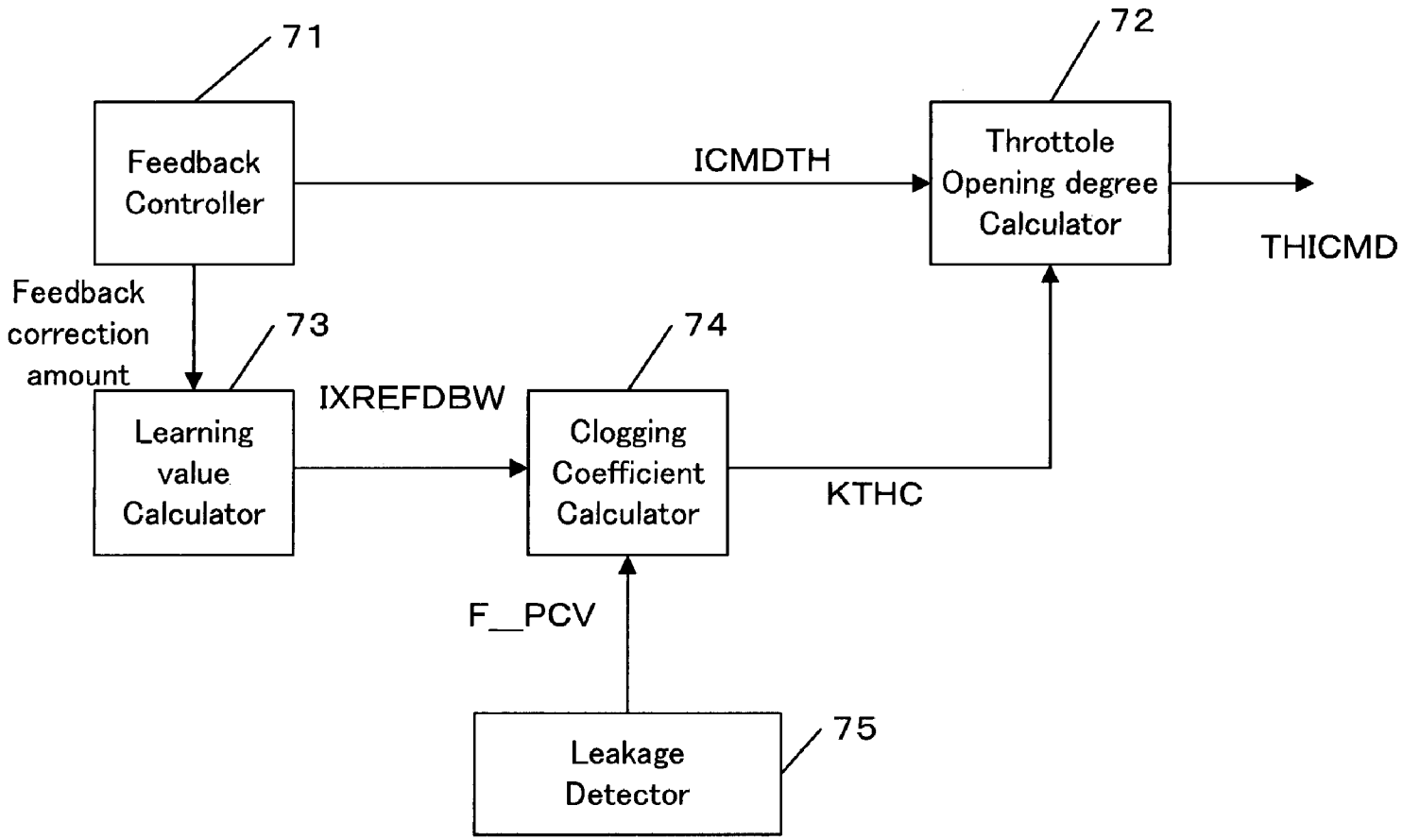
FIG. 2 shows a block diagram of an intake air amount control apparatus in accordance with one embodiment of the present invention.

FIG. 2 shows a block diagram of an intake air amount control apparatus in accordance with one embodiment of the present invention. Respective blocks are typically implemented by the ECU 60. A feedback controller 71 performs a feedback control for controlling the opening degree of the throttle valve so that the engine rotational speed converges to a desired rotational speed when during engine idling. For example, a PID control is used as a feedback control. The feedback controller 71 calculates a controlled variable ICMDTH for controlling the opening degree of the throttle valve. The controlled variable is calculated, for example, according to the following equation (1):

$$ICMDTH=(IFB+ILOAD)\times KIPA+IPA \quad (1)$$

In the equation (1), IFB represents a feedback correction amount (or feedback gain). In the case of using the PID control, the feedback correction amount includes a proportional gain, an integral gain and a derivative gain. LOAD represents a load correction term that is set in accordance with an electric load imposed on the engine, a compressor load of an air conditioner, a power steering load, and whether or not an automatic transmission is in-gear. KIPA and IPA are a correction coefficient and a correction term, which are established in accordance with the atmospheric pressure.

A learning value calculator 73 calculates a first learning value IXREFN and a second learning value IXREFDBW based on the above integral gain.

Figure 3:
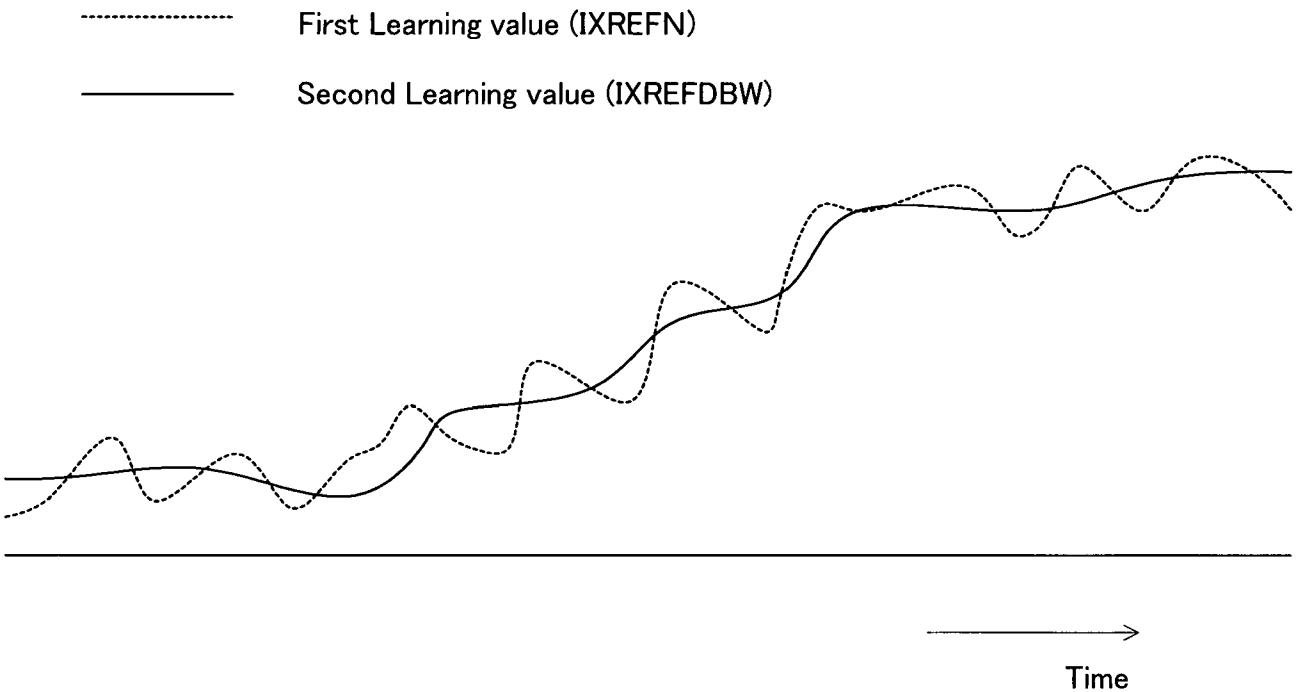
FIG. 3 is a graph showing time-dependent changes in first and second learning values in accordance with clogging in an intake manifold in accordance with one embodiment of the present invention.

An example of time-dependent changes of these learning values will be described referring to FIG. 3. The first learning value (IXREFN), which is shown by a dotted line, indicates a value obtained by smoothing the integral gain (IAIN). The second learning value (IXREFDBW), which is shown by a solid line, indicates a value obtained by smoothing the first learning value. FIG. 3 shows a state where the first learning value and the second learning value are changing due to clogging of the intake manifold (including the throttle valve), which may be caused by years of use. The first and second learning values increase because the intake air amount into the engine decreases as the degree of clogging increases.

Thus, by calculating the second learning value through use of the integral gain IAIN that is used for feedback-controlling the engine rotational speed during idle operation, it can be determined how clogging of the intake manifold changes.

Referring back to FIG. 2, a clogging coefficient calculator 74 calculates a clogging coefficient KTHC based on the second learning value IXREFDBW. The clogging coefficient KTHC indicates to what degree the intake manifold is clogging. As the value of the clogging coefficient is greater, the degree of clogging increases. In one embodiment of the present invention, the clogging coefficient KTHC is calculated so that a difference between a current value of the clogging coefficient KTHC, which is calculated in the current operating cycle, and a previous value of the clogging coefficient KTHC, which is calculated in the previous operating cycle, is kept within a predetermined range.

A throttle opening degree calculator 72 calculates a desired opening degree THICMD of the throttle valve based on the controlled variable ICMDTH and the clogging coefficient KTHC. The opening degree of the throttle valve is controlled so that it converges to the desired throttle opening degree THICMD. Thus, the throttle valve is controlled to the opening degree set in accordance with the degree of clogging of the intake manifold. The opening degree of the throttle valve is set to be larger as the degree of clogging increases so that the desired air amount can be taken into the engine.

A leakage detector 75 detects a leakage (including a hole and a disconnection) of the blow-by gas passage 25. The detection may be implemented using any appropriate method. If a leakage of the blow-by gas passage 25 is detected, the leakage detector 75 sets a flag F_PCV. If the flag F_PCV is set, the clogging coefficient calculator 74 prohibits the calculation of the clogging coefficient KTHC.

If a leakage in the blow-by gas passage 25 occurs, the intake air amount increases. If the calculation of the clogging coefficient is continued, such increase in the intake air amount causes an erroneous determination that the clogging has been eliminated. In order to avoid such erroneous determination, the calculation of the clogging coefficient KTHC is prohibited when a leakage is detected in the blow-by gas passage 25.

Figure 4:
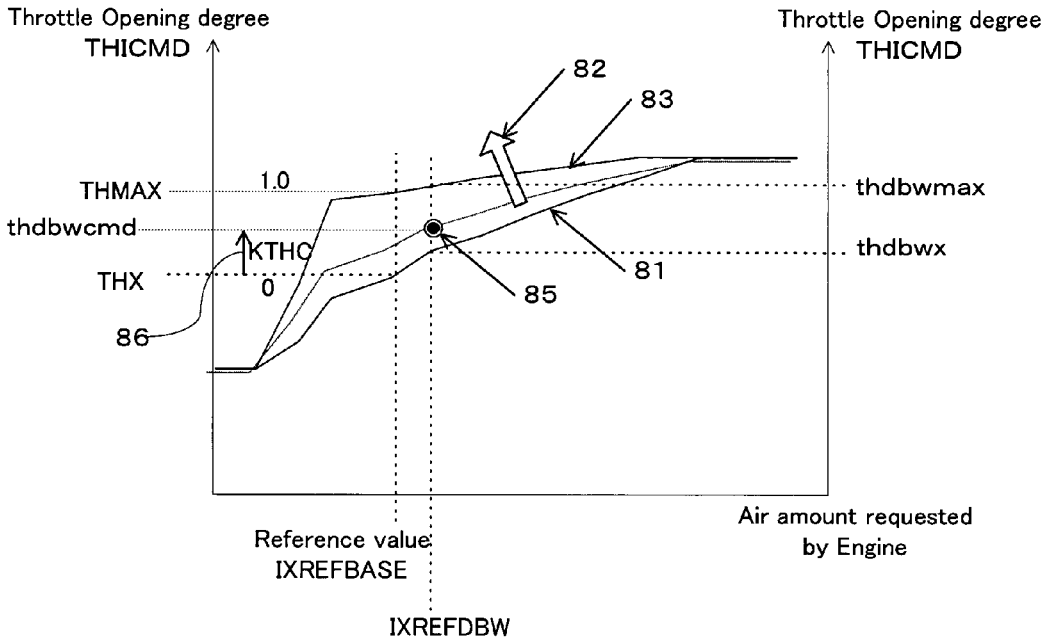
FIG. 4 shows a map for determining a clogging coefficient in accordance with one embodiment of the present invention.

Referring to FIG. 4, a specific method for calculating the clogging coefficient KTHC will be described. The figure shows a map indicating the opening degree THICMD of the throttle valve that is to be set in accordance with the amount of air taken into the engine. It should be noted the left and right vertical axes indicate the same scale for the purpose of illustration.

A reference number 81 indicates a throttle characteristic when there is no clogging in the intake manifold. The throttle characteristic shifts along a direction of an arrow 82 as clogging of the intake manifold increases. A reference number 83 indicates a throttle characteristic when it is determined that there is a maximum clogging in the intake manifold. The maximum clogging indicates a state beyond which the intake air amount control by the throttle valve may be impossible.

A reference value IXREFBASE is predetermined. The reference value IXREFBASE is typically determined based on an air amount beyond which clogging may occur in the intake manifold. In other words, if the air amount taken into the engine exceeds the reference value IXREFBASE, it indicates a possibility that clogging has occurred in the intake manifold.

A lower limit value of the throttle opening degree at the reference value IXREFBASE is referred to as a reference lower limit value THX. An upper limit value of the throttle opening degree at the reference value IXREFBASE is referred to as a reference upper limit value THMAX. The clogging coefficient KTHC takes a value within a range defined by the reference lower limit value THX and the reference upper limit value THMAX. In this embodiment, the clogging coefficient KTHC is defined so that a value of the clogging coefficient KTHC corresponding to the reference lower limit value THX is zero and a value of the coefficient KTCH corresponding to the reference upper limit value THMAX is 1. As the value of the KTHC is greater, it indicates that clogging in the intake manifold is greater.

The air amount taken into the engine is typically represented by the controlled variable ICMDTH. As described above, the controlled variable ICMDTH is calculated based on the feedback correction amount that includes the integral gain. However, the degree of clogging in the intake manifold is reflected in the second learning value that is calculated based on the integral gain. Therefore, in order to calculate the clogging coefficient, the clogging coefficient calculator 74 refers to the map based on the second learning value IXREFDBW.

An upper limit value thdbwmax and a lower limit value thdbwx that are corresponding to the second learning value IXREFDBW are calculated based on the throttle characteristics 81 and 83. Using a clogging coefficient KTHCLAST calculated in the previous operating cycle, a point 85 at which the throttle opening degree corresponding to the second learning value IXREFDBW is determined between the upper limit value thdbwmax and the lower limit value thdbwx. A throttle opening degree thdbwcmd corresponding to the point 85 is output.

In order to calculate the clogging coefficient KTHC for the current operating cycle, it is determined where the throttle opening degree thdbwcmd is located between the reference lower limit value THX and the reference upper limit value THMAX. As described above, the clogging coefficient KTHC is defined so that its value on the throttle characteristic 81 at the reference value IXREFBASE is zero and its value on the throttle characteristic 83 at the reference value IXREFBASE is 1.0. Therefore, the clogging coefficient KTHC corresponding to the throttle opening degree thdbwcmd can be calculated by a simple proportional calculation based on the reference lower limit value THX and the reference upper limit value THMAX. Specific calculation equations will be described later. Thus, KTHC having a magnitude shown by a reference number 86 is determined.

Figure 5:
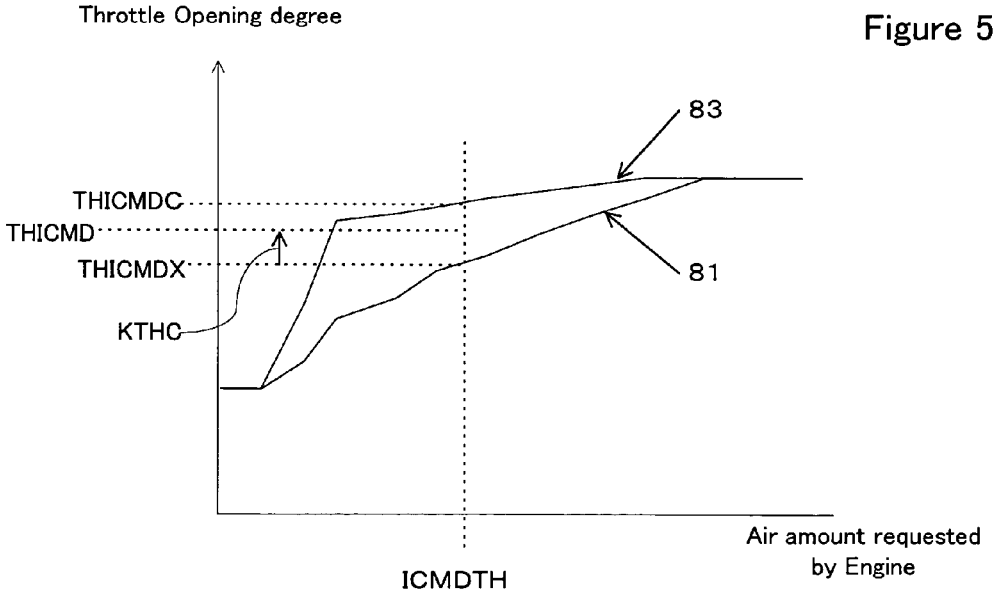
FIG. 5 shows a map for determining a desired throttle opening degree THICMD in accordance with one embodiment of the present invention.

Referring to FIG. 5, a method for calculating the desired throttle opening degree THICMD will be described. A map shown in FIG. 5 is the same as in FIG. 4. The throttle opening calculator 72 refers to the map based on the controlled variable ICMDTH calculated by the feedback controller 71.

The desired throttle opening degree that is to be used for actually controlling the opening degree of the throttle valve may need to be calculated considering not only clogging but also other factors. Therefore, the map is referred to based on the controlled variable ICMDTH that is calculated considering the engine load and the other factors as described above referring to the equation (1).

An upper limit value THICMDC and a lower limit value THICMDX corresponding to the controlled variable ICMDTH are calculated based on the throttle characteristics 81 and 83. By using the clogging coefficient KTHC calculated by the clogging coefficient calculator 74, the desired throttle opening THICMD corresponding to the clogging coefficient KTHC can be determined by a simple proportional calculation based on the upper limit value THICMDC and the lower limit value THICMDX. Specific calculation equations will be described later.

Figure 6:
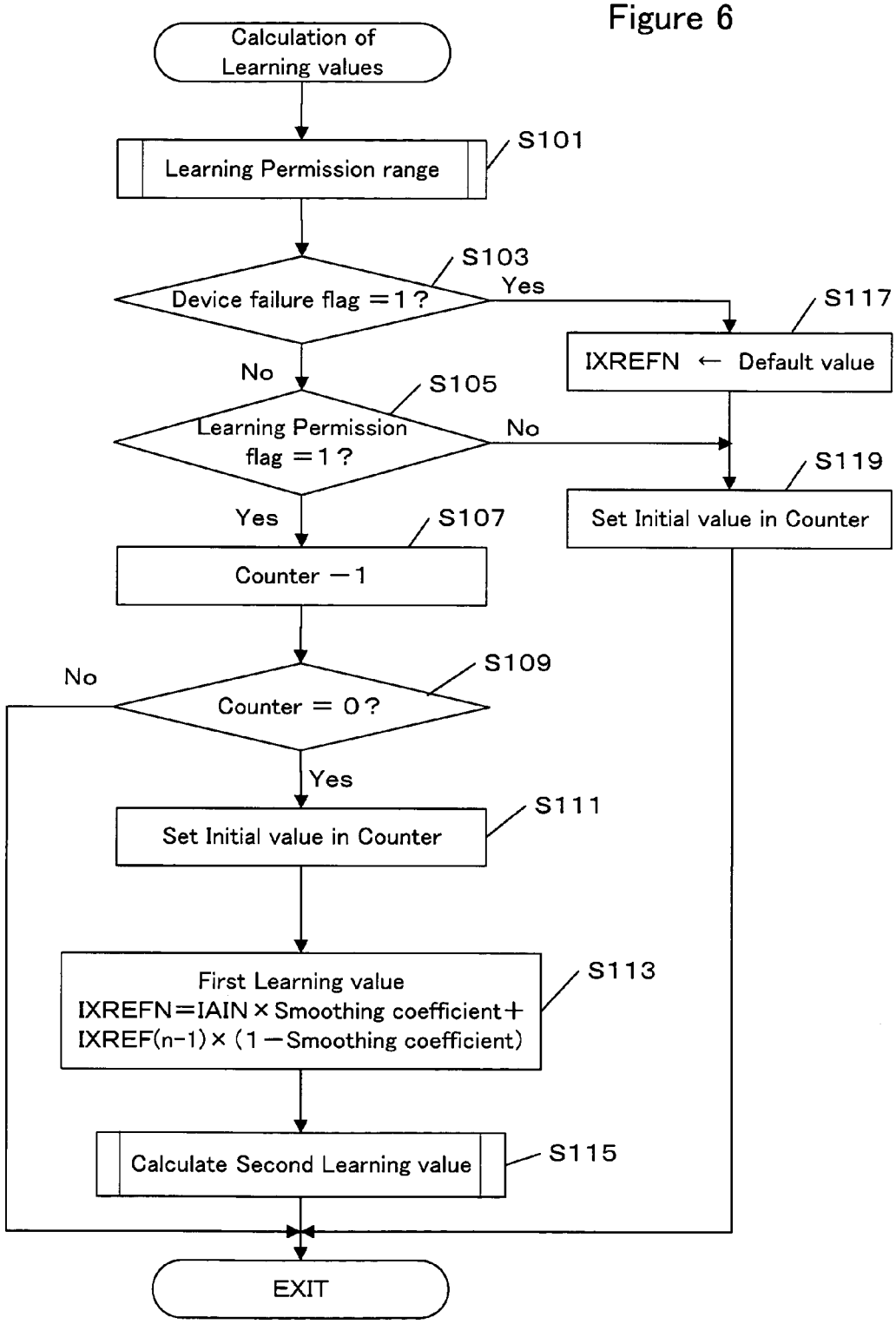
FIG. 6 shows a flowchart of a process for calculating a first learning value in accordance with one embodiment of the present invention.
Figure 7:
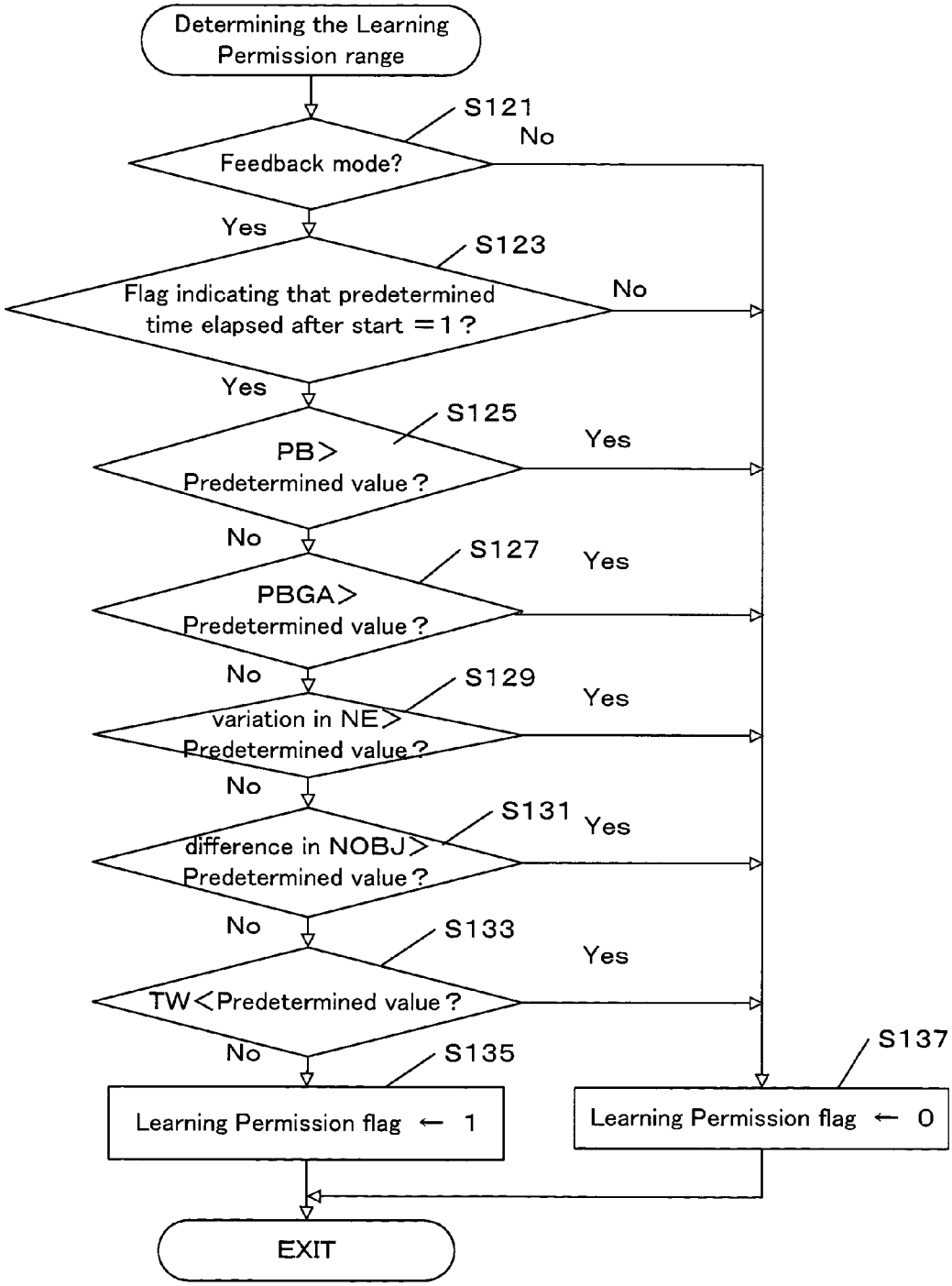
FIG. 7 shows a flowchart of a process for determining a learning permission range in accordance with one embodiment of the present invention.
Figure 8:
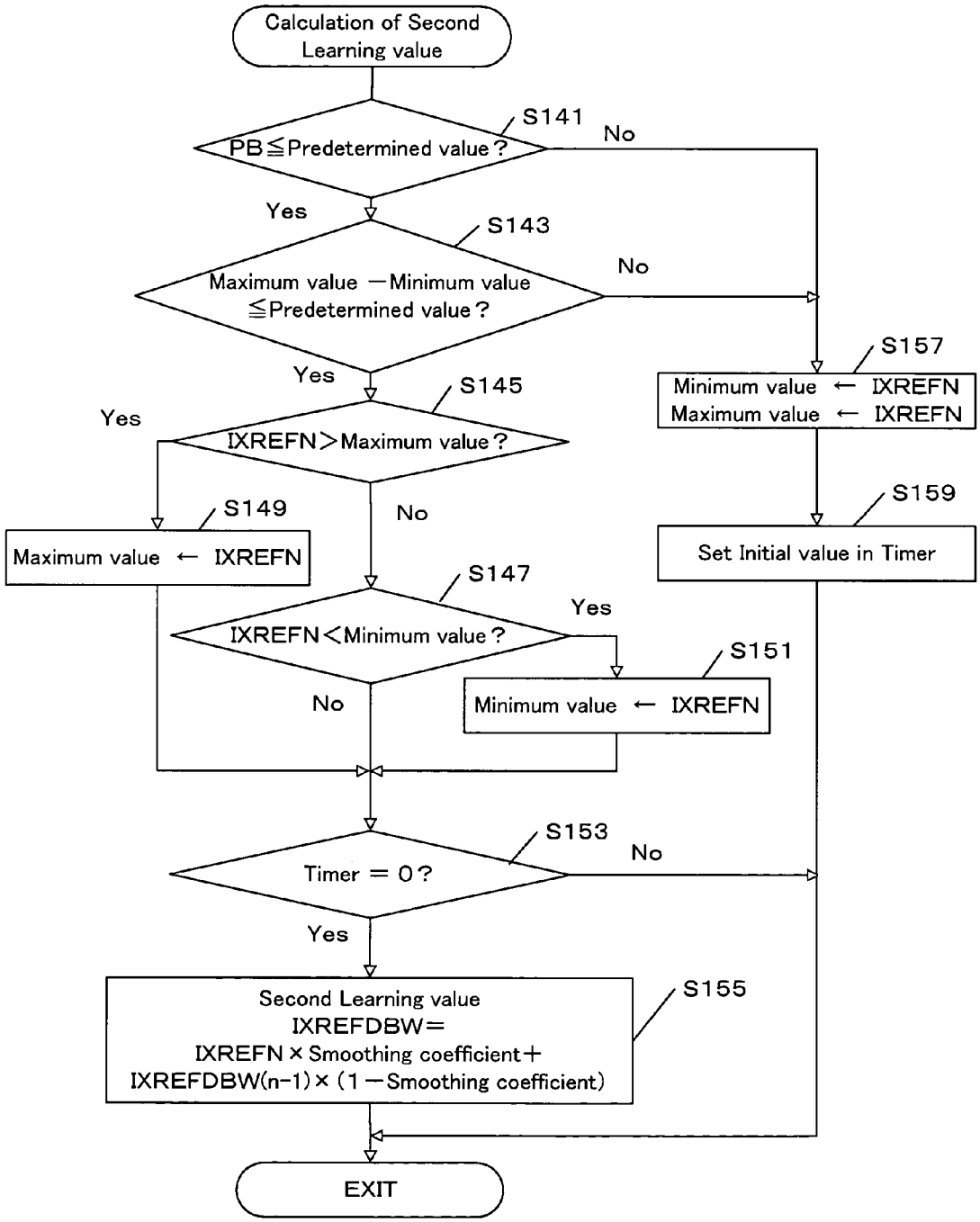
FIG. 8 shows a flowchart of a process for calculating a second learning value in accordance with one embodiment of the present invention.

Referring to FIGS. 6 through 8, a process for calculating the second learning value will be described. This process is performed at a predetermined time interval.

In step S101, a subroutine is performed for determining whether the operating condition of the engine is within a learning permission range, that is, whether the operating condition of the engine is suitable for calculating the learning values. This subroutine will be described referring to FIG. 7.

In step S103, it is determined whether a flag indicating a failure in any device on the vehicle has been set to one. If the flag has not been set to one, the process proceeds to step S105. If the flag has been set to one, a default value is set in the first learning value IXREFN (S117). An initial value is set in a counter that defines an interval at which the learning values are calculated (S119), and then the process exits the routine.

In step S105, it is determined whether a learning permission flag has been set to one. The learning permission flag is a flag that is to be set in the subroutine performed in step S101. If the learning permission flag has been set to one, the process proceeds to step S107. If the learning permission flag has not been set to one, the initial value is set in the counter (S119), and the process exits the routine.

In step S107, the counter value is decremented by one. In step S109, it is determined whether the counter value has reached zero. If the counter value has not reached zero, the process exits the routine.

If the counter value has reached zero in step S109 when this routine is re-entered, the initial value is set in the counter (S111). The process proceeds to step S113, in which the first learning value is calculated. The first learning value IXREFN is calculated in accordance with the following equation (2):

$$IXREFN = IAIN \times \text{“smoothing coefficient”} + IXREFN(n-1) \times (1 - \text{“smoothing coefficient”}) \quad (2)$$

IAIN represents the integral gain of the PID feedback control as described above. IXREFN(n−1) represents the first learning value calculated in the previous cycle. The smoothing coefficient is, for example, 0.7. In this embodiment, the learning value is obtained by using the smoothing coefficient. Alternatively, a moving average of the integral gain IAIN may be used as a learning value. Thus, the calculated learning value is stored in the RAM 60*c* (FIG. 1).

In step S115, a subroutine (FIG. 8) for calculating the second learning value is performed.

A process for determining the learning permission range, which is performed in step S101 of FIG. 6, will be described referring to FIG. 7. In step S121, based on a status code that indicates an operating mode of the engine, it is determined whether the engine is in a mode for performing a feedback control for the idle rotational speed. If the answer of step S121 is No, that is, if the current mode is a mode where an open-loop control is to be performed, the learning permission flag is set to zero (rejection) in step S137 and then the process exits the routine. If the answer of step S121 is Yes, the process proceeds to step S123, in which it is determined whether a flag indicating that a predetermined time has elapsed after the engine start has been set to one. If the flag has not been set to one, the learning permission flag is set to zero (S137) and then the process exits the routine. Thus, the learning operation is prohibited because the engine condition is not stable immediately after the engine start.

If it is determined that the predetermined time has elapsed after the engine start, the process proceeds to step S125, in which it is determined whether the intake manifold pressure PB is greater than a predetermined value. The intake manifold pressure PB indicates engine load. If the intake manifold pressure PB is larger than the predetermined value, it indicates that the engine load is high. Since the engine condition is not suitable for calculating the learning values, the process proceeds to step S137 and then exits this routine. If the intake manifold pressure PB is equal to or less than the predetermined value, the process proceeds to step S127, in which it is determined whether the gauge pressure PBGA, which is a difference between the atmospheric pressure PA and the intake manifold pressure PB, exceeds a predetermined value. If the gauge pressure PBGA is larger than the predetermined value, it indicates that engine load is high. Since the engine condition is not suitable for calculating the learning values, the learning permission flag is set to zero (S137) and then the process exits the routine.

If the gauge pressure PBGA is equal to or less than the predetermined value, the process proceeds to step S129, in which it is determined whether a variation in the engine rotational speed NE exceeds a predetermined value. If the variation of the rotational speed NE is larger than the predetermined value, it indicates that the engine condition is not suitable for calculating the learning values. The learning permission flag is set to zero (S137) and then the process exits the routine. If the variation in the rotational speed is equal to or less than the predetermined value, the process proceeds to step S131, in which it is determined whether a difference between a desired rotational speed NOBJ calculated in the current cycle and a desired rotational speed NOBJ calculated in the previous cycle exceeds a predetermined value. If the difference is larger than the predetermined value, it indicates that the engine rotation is not stable. Since the engine condition is not suitable for calculating the learning values, the learning permission flag is set to zero (S137) and then the process exits the routine.

If the difference between the current value and the previous value for the desired rotational speed NOBJ is equal to or less than the predetermined value, the process proceeds to step S133, in which it is determined whether the engine water temperature TW is lower than a predetermined value. If the engine water temperature TW is lower than the predetermined value, it indicates that the engine is not stable. Since the engine condition is not suitable for calculating the learning values, the learning permission flag is set to zero (S137) and the process exits the routine. If the engine water temperature TW is equal to or higher than the predetermined value, the learning permission flag is set to one (S135) and the process exits the routine.

Referring to FIG. 8, a process for calculating the second learning value, which is performed in step S115 of FIG. 6, will be described. In step S141, it is determined whether the intake manifold pressure PB is equal to or less than a predetermined value. Since the intake manifold pressure PB represents engine load as described above, a small intake manifold pressure PB indicates that the engine load is low. If the intake manifold pressure PB is equal to or less than the predetermined value, the process proceeds to step S143, in which it is determined whether a difference between a maximum value and a minimum value in the first learning value calculated in step S113 is equal to or less than a predetermined value. This determination is performed so as to calculate the second learning value under a condition where a difference between the maximum value and the minimum value in the first learning value IXREFN calculated over a predetermined time period, which is established by a timer in step S159, is equal to or less than the predetermined value. Thus, the learning value can be determined in a range in which the operating condition of the engine is stable.

If the answer of step 143 is No, the process proceeds to step S157, in which the first learning value is set in both of the maximum value and the minimum value of IXREFN. In step S159, a predetermined initial value is set in the timer, and then the process exits the routine. A function of the timer of step S159 will be described later.

When the routine is re-entered, the answer of step S143 is Yes because the maximum value and the minimum value has been set to the same value in step S157. The process proceeds to step S145, in which it is determined whether the first learning value IXREFN calculated in step S113 of FIG. 6 exceeds the maximum value established in step S157. If the answer of the step is Yes, the maximum value is replaced with the current value of the first learning value IXREFN (S149). If the answer of step S113 is No, it is determined in step S147 whether the current value of the first learning value IXREFN is less than the minimum value. If the answer of step S147 is Yes, the minimum value is replaced with the current value IXREFN (S151). When such updating process for the maximum and minimum values are completed, it is determined in step S153 whether the timer that has been set to the initial value in step S159 is zero. That is, it is determined whether a condition where a difference between the maximum value and the minimum value is equal to or less than the predetermined value has continued over a time period established by the timer. If the timer is zero, the process proceeds to step S155, in which the second learning value is calculated. If the timer has not reached zero, the process exits the routine.

In step S155, the second learning value IXREFDBW is calculated in accordance with the following equation (3):

$$IXREFDBW = IXREFN \times \text{smoothing coefficient} + IXREFDBW(n-1) \times (1 - \text{smoothing coefficient}) \quad (3)$$

The smoothing coefficient is, for example, 0.7. Alternatively, it may be different from the smoothing coefficient for the first learning value.

A process for calculating the clogging coefficient KTHC will be described referring to FIG. 9. This routine is performed at a predetermined time interval.

In step S201, the value of a flag F_KTHCINI is examined. The flag F_KTHCINI has been initialized to zero when an operating cycle, which is a cycle from engine start to engine stop, is started. Therefore, when this routine is first performed, the process proceeds to step S203, in which the current value of the clogging coefficient KTHC is stored as KTHCLAST. That is, the last calculated clogging coefficient in the previous operating cycle is stored as KTHCLAST.

In steps S205 and S207, throttle characteristics 83 and 81 shown in FIG. 4 are referred to based on the reference value IXREFBASE to determine a reference upper limit value THMAX and a reference lower limit value THX of the throttle opening degree. As described above, at the reference value IXREFBASE, the value of the clogging coefficient KTHC is zero when the throttle opening degree is equal to THX and one when the throttle opening degree is equal to THMAX. In step S209, the flag F_KTHCINI is set to one, indicating that the initial process for the clogging coefficient is completed.

When this routine is re-entered, the value of the flag F_KTHCINI is one. The process proceeds to step S211, in which the value of the flag F_PCV is examined. The flag F_PCV is a flag that is to be set to one when a leakage of the blow-by gas passage 25 (FIG. 1) is detected. If the value of the flag F_PCV is one, the process proceeds to step S213, in which the clogging coefficient KTHCLAST calculated in the previous operating cycle is set in the clogging coefficient KTHC for the current operating cycle. Thus, when a leakage of the blowby gas passage is detected, updating of the clogging coefficient KTHC is prohibited.

If the answer of step S211 is No, a process for updating the clogging coefficient KTHC shown in steps S215 through step S224 is performed. In step S215, the throttle characteristic 83 of the map as shown in FIG. 4 is referred to based on the second learning value IXREFDBW calculated in step S155 of FIG. 8 to determine an upper limit value thdbwmax.

In step S217, the throttle characteristic 81 of the map as shown in FIG. 4 is referred to based on the second learning value IXREFDBW to determine a lower limit value thdbwx.

In step S219, using the clogging coefficient KTHCLAST calculated in the previous operating cycle, a throttle opening degree thdbwcmd corresponding to the second learning value IXREFDBW is calculated in accordance with the equation (4). The throttle opening degree thdbwcmd corresponding to the point 85 (FIG. 4) is calculated in accordance with the equation (4).

$$\text{throttle opening } thdbwcmd = KTHCLAST \times thdbwmax + (1 - KTHCLAST) \times thdbwx \quad (4)$$

In step S221, a temporary clogging coefficient kthctmp is calculated by determining where the throttle opening thdbwcmd is located between the reference upper limit value THMAX and the reference lower limit value THX as shown in the equation (5).

$$\text{temporary clogging coefficient } kthctmp = \frac{(thdbwcmd - THX)}{(THMAX - THX)} \quad (5)$$

As the second learning value IXREFDBW increases, the temporary throttle opening degree thdbwcmd increases and hence the temporary clogging coefficient kthctmp increases.

In step S223, an updating allowance range is set for the clogging coefficient KTHCLAST calculated in the previous operating cycle. Specifically, an upper limit value kthcmax of the updating allowance range is calculated by adding a predetermined value to the clogging coefficient KTHCLAST and a lower limit value kthcmin is calculated by subtracting the predetermined value from the clogging coefficient KTHCLAST.

In step S224, the temporary clogging coefficient kthctmp is limited by the updating allowance range. Specifically, when the temporary clogging coefficient kthctmp exceeds the upper limit value kthcmax, the clogging coefficient KTHC is set to the upper limit value kthcmax. On the other hand, when the temporary clogging coefficient kthctmp is below the lower limit value kthcmin, the clogging coefficient KTHC is set to the lower limit value kthcmin. Thus, a range within the clogging coefficient KTCH is updated is limited.

Figure 10:
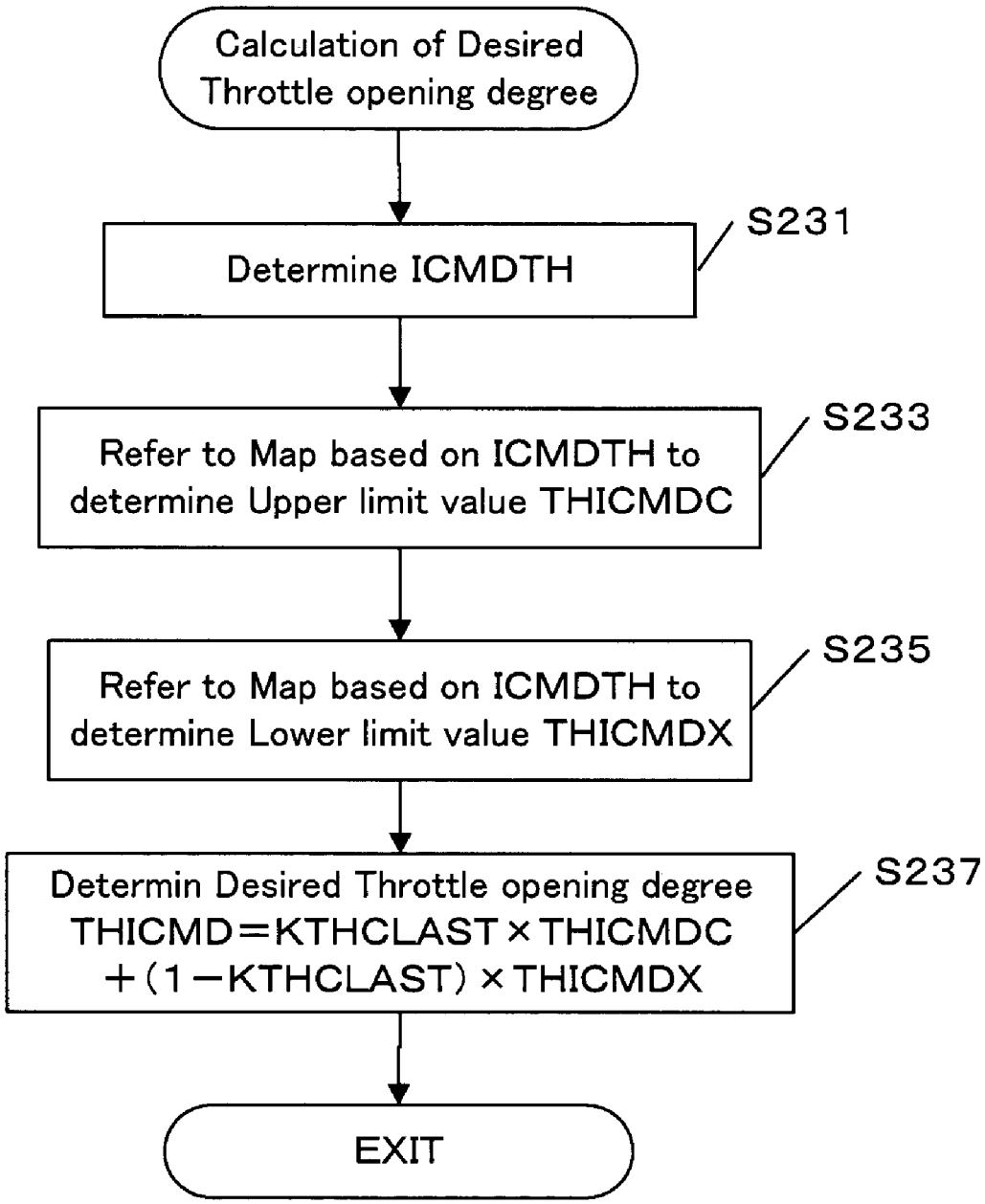
FIG. 10 shows a flowchart of a process for calculating a desired throttle opening degree in accordance with one embodiment of the present invention.

Referring to FIG. 10, a process for calculating a desired throttle opening THICMD will be described. This routine is performed at a predetermined time interval.

In step S231, the controlled variable ICMDTH is calculated in accordance with the above-described equation (1). In steps S233 and step S235, throttle characteristics 83 and 81 of the map as shown in FIG. 5 are referred to based on the controlled variable ICMDTH to determine an upper limit value THICMDC and a lower limit value THICMDX corresponding to the controlled variable ICMDTH.

In step S237, as shown in the equation (6), the clogging coefficient KTHCLAST calculated in the previous operating cycle is used to perform a proportional calculation upon the upper limit value THICMDC and the lower limit value THICMDX. Thus, the desired throttle opening THICMD is calculated.

$$\text{desired throttle opening } THICMD = KTHCLAST \times THICMDC + (1 - KTHCLAST) \times THICMDX \quad (6)$$

The reason why the clogging coefficient KTHCLAST calculated in the previous operating cycle is used because the updating process for the clogging coefficient KTCH in the current operating cycle is underway at a predetermined time interval and hence the value of the clogging coefficient for the current operating cycle has not been established yet. Since the clogging of the intake manifold changes little in a short time period such as one operating cycle, an appropriate desired throttle opening degree can be determined even by using the clogging coefficient KTHCLAST calculated in the previous operating cycle.

Figure 11:
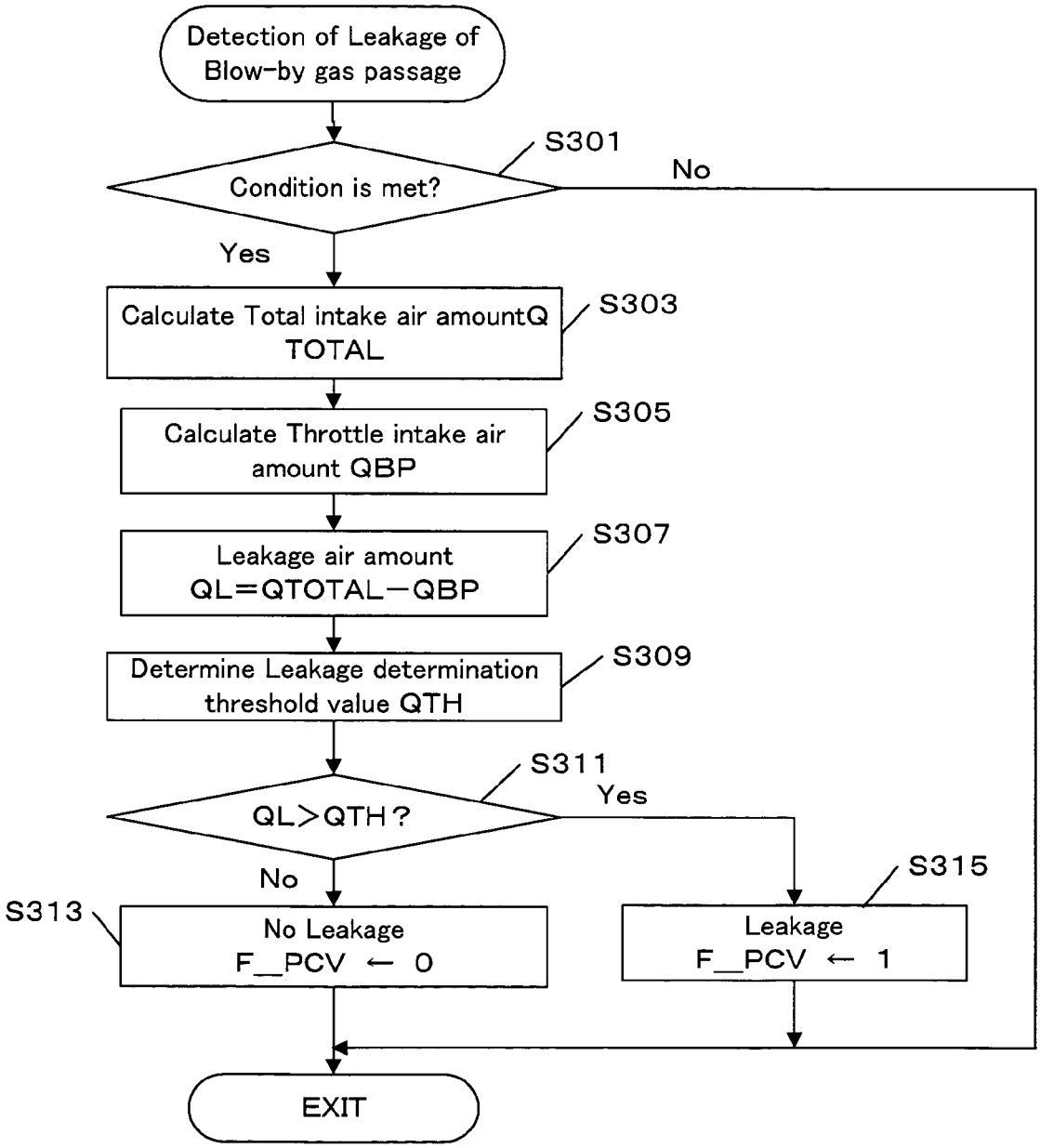
FIG. 11 shows a flowchart of a process for detecting a leakage in a blow-by gas passage in accordance with one embodiment of the present invention.

Referring to FIG. 11, a process for detecting a leakage of the blow-by gas passage will be described. This routine is performed at a predetermined time interval.

In step S301, it is determined whether a condition for detecting an abnormality of the blow-by gas passage is met. This condition may include, for example, a stable operating condition of the engine. The operating condition of the engine can be determined based on parameters such as engine water temperature, vehicle speed, air/fuel ratio and so on.

In step S303, a total intake air amount QTOTAL of the engine 1 is calculated in accordance with the following equation (7):

$$QTOTAL = TIM \times 2NE \times KC / \sigma A \quad (7)$$

where $$KC = KTQ \times \sigma G \times 14.7$$

$$\sigma A = [1.293/(1+0.00367TA)] \times (PA/PA0)$$

In the equation (7), TIM represents a basic fuel injection time, KC represents a coefficient for converting the fuel injection time TIM to an intake air amount, and σA represents the density of the atmosphere. KTQ represents a coefficient for converting the fuel injection time to the amount (volume) of fuel, σG represents the density of fuel, and 14.7 indicates the stoichiometric air/fuel ratio. TA represents an intake air temperature detected by the intake air temperature sensor 34 (FIG. 1), PA represents an atmospheric pressure detected by the atmospheric pressure sensor 56 (FIG. 1), and PA0 represents the reference atmospheric pressure (=101.3 kPa).

In step S305, an intake air amount QBP taken into the engine 10 through the throttle valve 14 is calculated in accordance with the following equation (8):

$$QBP = ICMDTH \times KIQ \quad (8)$$

KIQ is a coefficient for converting the controlled variable ICMDTH to the amount of air.

In step S307, the throttle intake air amount QBP is subtracted from the total intake air amount QTOTAL to calculate a leakage air amount QL that is introduced into the engine due to a leakage such as disconnection of the blow-by gas passage 25.

In step S309, a predetermined map is referred to based on the gauge pressure PBG to calculate a leakage determination threshold value QTH. The map is established so that the threshold value QTH decreases as the gauge pressure PBG increases (that is engine load increases).

In step S311, if QL>QTH, it is determined that there is a leakage, and then the value of one is set in the flag F_PCV (S315). If QL≦QTH, it is determined that there is no leakage, and then zero is set in the flag F_PCV (S313).

The process for detecting a leakage of the blow-by gas passage shown in FIG. 11 is an exemplary embodiment. As described above, any other appropriate method may be used for detecting a leakage of the blow-by gas passage.

Figure 12:
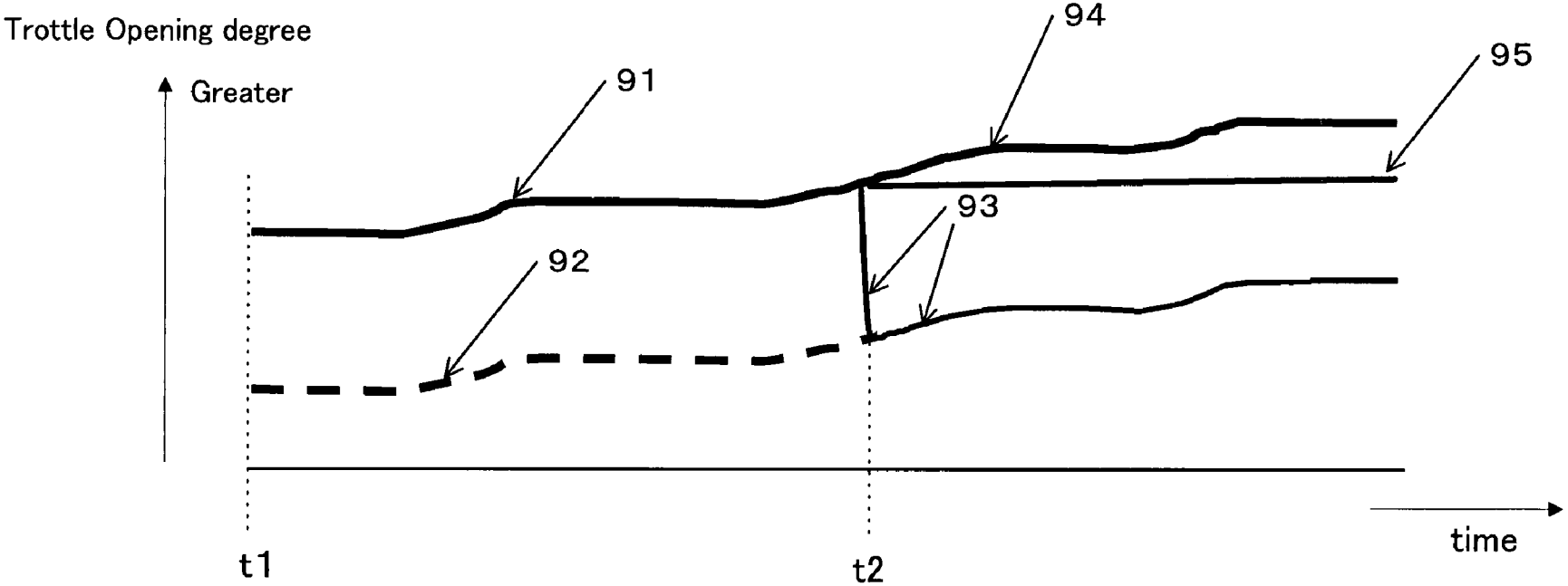
FIG. 12 shows a graph illustrating an effect of an intake air amount control in accordance with one embodiment of the present invention.

Referring to FIG. 12, an effect of the intake air amount control in accordance with one embodiment of the present invention when a leakage occurs in the blow-by gas passage will be described.

A reference number 91 shows a change in the throttle opening degree in the case where there is clogging in the intake manifold. A reference number 92 shows a change in the throttle opening degree in the case where there is no clogging in the intake manifold. When there is clogging in the intake manifold, the intake air amount decreases. Therefore, the throttle opening degree is controlled to increase so as to compensate such decrease of the intake air amount caused by the clogging.

Over the time period from t1 to t2, the throttle opening degree is controlled as shown by the reference number 91. A disconnection occurs in the blow-by gas passage 25 at t2.

A reference number 93 shows a change of the throttle opening degree according to the conventional schemes. The intake air amount abruptly increases because the disconnection occurs in the blow-by gas passage 25. This abrupt increase of the intake air amount leads to an erroneous determination that the clogging has been eliminated. As a result, the value of the clogging coefficient KTHC is made small, and the throttle opening degree is also made small.

After the disconnection of the blow-by gas passage 25 is repaired under such a condition, the throttle opening degree is small as shown by the reference number 93 despite the fact that the clogging has not been yet eliminated. This causes a shortage of the intake air amount and hence makes the operating condition of the engine unstable.

According to the present invention, updating the clogging coefficient is prohibited when a disconnection of the blowby gas passage 25 is detected. The throttle opening changes as shown in a reference number 94 because the clogging coefficient is not updated. Therefore, after the disconnection of the blowby gas passage 25 is repaired, the intake air amount control can be performed based on the appropriate throttle opening.

As described above referring to one example shown in FIG. 11, it is typically determined that a leakage occurs in the blow-by gas passage if there is a difference between an air amount that is actually taken into the engine (QTOTAL in the example of FIG. 11) and a desired intake air amount (QBP in the example of FIG. 11). On the other hand, the control unit uses the clogging coefficient to control the throttle valve to cause the actual intake air amount to converge to the desired intake air amount.

If the clogging coefficient is updated immediately after a leakage is detected in the blow-by gas passage, the control unit may make an erroneous determination that the clogging has been eliminated. As a result, the control unit may instantly change the throttle opening degree as shown by the reference number 93 in order to cope with the actually increased intake air amount. Since the control unit determines that the actual intake air amount has been adapted to the desired intake air amount by virtue of the change of the throttle opening degree, the control unit cannot identify that such increase in the intake air amount has been caused by the leakage. Therefore, it may be determined that there is no leakage despite the fact that a disconnection has actually occurred in the blow-by gas passage.

According to the present invention, a range within which the clogging coefficient KTCH is updated is limited as shown in step S224 of FIG. 9. By limiting such a range within which the clogging coefficient KTCH is updated, the throttle opening degree can be controlled to change as shown by the reference number 95 even if the clogging coefficient is updated. In other words, although the clogging coefficient is updated to decrease due to the increase of the intake air amount, the amount the throttle opening degree decreases can be limited because the amount of update for the clogging coefficient is limited. Therefore, although the actual intake air amount into the engine increases when a disconnection occurs, the throttle opening degree is not necessarily changed to adapt to the increased amount of the intake air. As a result, since a difference is formed between the actual intake air amount into the engine and the desired intake air amount, it is ensured that occurrence of the leakage is detected.

The present invention can be applied to a general-purpose engine (for example, an outboard motor).

What is claimed is:

1. A control apparatus for controlling an intake air amount into an engine, comprising:

a control valve provided in an intake air passage into the engine; and a control unit configured to:

update a clogging coefficient based on a feedback correction amount for feedback controlling a rotational speed of the engine during idling operation, the clogging coefficient indicating a degree of clogging of the intake air passage of the engine;

determine a desired opening degree of the control valve based on the clogging coefficient;

cause an opening degree of the control valve to converge to the desired opening degree to control the intake air amount into the engine; and prohibit the update of the clogging coefficient if a leakage in a blow-by gas passage connected between the engine and the intake air passage is detected.

2. The control apparatus of claim 1, wherein the control unit is further configured to update the clogging coefficient so that a difference between a current value of the clogging coefficient and a previous value of the clogging coefficient is within a predetermined range.

3. The control apparatus of claim 1, wherein the control unit is further configured to:

determine based on the feedback correction amount a controlled variable for controlling the opening degree of the control valve;

determine the desired opening degree of the control valve based on the controlled variable and the clogging coefficient.

4. The control apparatus of claim 3, wherein the control unit is further configured to:

refer to a first characteristic based on the controlled variable to determine a first opening degree, the first characteristic indicating a relationship between the intake air amount and the opening degree of the control valve when there is no clogging in the intake air passage;

refer to a second characteristic based on the controlled variable to determine a second opening degree, the second characteristic indicating a relationship between the intake air amount and the opening degree of the control valve when there is a maximum clogging in the intake air passage beyond which the intake air amount may be out of control; and apply the clogging coefficient to a range defined by the first and second opening degrees to determine an opening degree corresponding to the controlled variable as the desired opening degree.

5. The control apparatus of claim 1, wherein the control unit is further configured to:

smooth the feedback correction amount to determine a learning value;

determine a current value of the clogging coefficient based on the learning value.

6. The control apparatus of claim 5, wherein the control unit is further configured to:

smooth an integral gain contained in the feedback correction amount; and smooth the smoothed integral gain to determine the learning value.

7. The control apparatus of claim 5, wherein the control unit is further configured to:

refer to a first characteristic based on the learning value to determine a first opening degree, the first characteristic indicating a relationship between the intake air amount and the opening degree of the control valve when there is no clogging in the intake air passage;

refer to a second characteristic based on the learning value to determine a second opening degree, the second characteristic indicating a relationship between the intake air amount and the opening degree of the control valve when there is a maximum clogging in the intake air passage beyond which the intake air amount may be out of control;

apply a previous value of the clogging coefficient to a range defined by the first and second opening degrees to determine an opening degree corresponding to the learning value;

refer to the first and second characteristics based on a reference intake air amount to determine a first reference opening degree and a second reference opening degree corresponding to the reference intake air amount, respectively; and determine the current value of the clogging coefficient based on a ratio of the opening degree corresponding to the learning value to a range defined by the first and second reference opening degrees.

8. The control apparatus of claim 7, wherein the reference intake air amount is set to an intake air amount beyond which a probability that there is clogging in the intake air passage is determined.

9. A method for controlling an intake air amount into an engine, comprising the steps of:

(a) updating a clogging coefficient based on a feedback correction amount for feedback controlling a rotational speed of the engine during idling operation if a leakage in a blow-by gas passage connected between the engine and the intake air passage is not detected, the clogging coefficient indicating a degree of clogging of the intake air passage of the engine;

(b) maintaining the clogging coefficient if a leakage in the blow-by gas passage is detected;

(c) determining a desired opening degree of a control valve provided in the intake air passage into the engine based on the clogging coefficient; and (d) controlling an opening degree of the control valve to converge to the desired opening degree.

10. The method of claim 9, wherein the step (a) further comprises the step of updating the clogging coefficient so that a difference between a current value of the clogging coefficient and a previous value of the clogging coefficient is within a predetermined range.

11. The method of claim 9, wherein the step (c) further comprises the steps of:

(c-1) determining based on the feedback correction amount a controlled variable for controlling the opening degree of the control valve; and (c-2) determining the desired opening degree of the control valve based on the controlled variable and the clogging coefficient.

12. The method of claim 11, wherein the step (c-2) further comprises the steps of:

referring to a first characteristic based on the controlled variable to determine a first opening degree, the first characteristic indicating a relationship between the intake air amount and the opening degree of the control valve when there is no clogging in the intake air passage;

referring to a second characteristic based on the controlled variable to determine a second opening degree, the second characteristic indicating a relationship between the intake air amount and the opening degree of the control valve when there is a maximum clogging in the intake air passage beyond which the intake air amount may be out of control; and applying the clogging coefficient to a range defined by the first and second opening degrees to determine an opening degree corresponding to the controlled variable as the desired opening degree.

13. The method of claim 9, wherein the step (a) further comprises the steps of:

(a-1) smoothing the feedback correction amount to determine a learning value; and (a-2) determining a current value of the clogging coefficient based on the learning value.

14. The method of claim 13, wherein the step (a-1) further comprises the steps of:

smoothing an integral gain contained in the feedback correction amount; and smoothing the smoothed integral gain to determine the learning value.

15. The method of claim 13, wherein the step (a-2) further comprises the steps of:

referring to a first characteristic based on the learning value to determine a first opening degree, the first characteristic indicating a relationship between the intake air amount and the opening degree of the control valve when there is no clogging in the intake air passage;

referring to a second characteristic based on the learning value to determine a second opening degree, the second characteristic indicating a relationship between the intake air amount and the opening degree of the control valve when there is a maximum clogging in the intake air passage beyond which the intake air amount may be out of control;

applying a previous value of the clogging coefficient to a range defined by the first and second opening degrees to determine an opening degree corresponding to the learning value;

referring to the first and second characteristics based on a reference intake air amount to determine a first reference opening degree and a second reference opening degree corresponding to the reference intake air amount, respectively; and determining the current value of the clogging coefficient based on a ratio of the opening degree corresponding to the learning value to a range defined by the first and second reference opening degrees.

16. The method of claim 15, wherein the reference intake air amount is set to an intake air amount beyond which a probability that there is clogging in the intake air passage is determined.

17. A control apparatus for controlling an intake air amount into an engine, comprising:

a control valve for adjusting the intake air amount into the engine;

means for calculating a clogging coefficient based on a feedback correction amount for feedback controlling a rotational speed of the engine during idling operation, the clogging coefficient indicating a degree of clogging of an intake air passage of the engine; and means for determining a desired opening degree of the control valve based on the clogging coefficient;

means for controlling an opening degree of the control valve to the desired opening degree;

means for detecting a leakage in a blow-by gas passage connected between the engine and the intake air passage; and means for prohibiting the calculation of the clogging coefficient if the leakage in the blow-by gas passage is detected.

18. The control apparatus of claim 17, further comprising:

means for calculating the clogging coefficient so that a difference between a current value of the clogging coefficient and a previous value of the clogging coefficient is within a predetermined range.

19. The control apparatus of claim 17, further comprising:

means for determining based on the feedback correction amount a controlled variable for controlling the opening degree of the control valve; and means for determining the desired opening degree of the control valve based on the controlled variable and the clogging coefficient.

20. The control apparatus of claim 17, further comprising:

means for smoothing the feedback correction amount to determine a learning value; and means for calculating the clogging coefficient based on the learning value.

* * * * *